US009708106B2

(12) United States Patent
Vovan

(10) Patent No.: US 9,708,106 B2
(45) Date of Patent: Jul. 18, 2017

(54) ENHANCED TAMPER EVIDENT BOWL WITH BLOCKED TAB

(71) Applicant: Pactiv LLC, Lake Forest, IL (US)

(72) Inventor: Terry Vovan, Rialto, CA (US)

(73) Assignee: Pactiv LLC, Lake Forest, IL (US)

( * ) Notice: Subject to any disclaimer, the term of this patent is extended or adjusted under 35 U.S.C. 154(b) by 158 days.

(21) Appl. No.: 14/485,593

(22) Filed: Sep. 12, 2014

(65) Prior Publication Data

US 2015/0060456 A1 Mar. 5, 2015

Related U.S. Application Data

(62) Division of application No. 11/315,654, filed on Dec. 21, 2005, now Pat. No. 8,833,589.

(51) Int. Cl.

| | |
|---|---|
| ***B65D 17/34*** | (2006.01) |
| ***B65D 43/02*** | (2006.01) |
| ***B65D 43/16*** | (2006.01) |

(52) U.S. Cl.

CPC ..... *B65D 43/0235* (2013.01); *B65D 43/021* (2013.01); *B65D 43/162* (2013.01); *B65D 2101/0015* (2013.01); *B65D 2543/0037* (2013.01); *B65D 2543/0062* (2013.01); *B65D 2543/00092* (2013.01); *B65D 2543/00194* (2013.01); *B65D 2543/00296* (2013.01); *B65D 2543/00509* (2013.01); *B65D 2543/00546* (2013.01); *B65D 2543/00685* (2013.01); *B65D 2543/00731* (2013.01); *B65D 2543/00796* (2013.01); *B65D 2543/00842* (2013.01)

(58) Field of Classification Search

CPC B65D 43/0235; B65D 43/162; B65D 43/021; B65D 2101/0015; B65D 2543/00092; B65D 2543/00194; B65D 2543/00296; B65D 2543/0037; B65D 2543/00509; B65D 2543/00546; B65D 2543/0062; B65D 2543/00685; B65D 2543/00731; B65D 2543/00796; B65D 2543/00842

USPC ..... 220/270

See application file for complete search history.

(56) References Cited

U.S. PATENT DOCUMENTS 5,507,406 A * 4/1996 Urciuoli ..... B65D 43/021 215/209

2007/0108210 A1* 5/2007 Alvares ..... B65D 21/0219 220/270

* cited by examiner

*Primary Examiner* — Anthony Stashick
*Assistant Examiner* — James M Van Buskirk
(74) *Attorney, Agent, or Firm* — Baker Botts L.L.P.

(57) ABSTRACT

A container which includes a base (12) that can hold food and a lid (14) that closes on the base, which clearly indicates if the lid has been opened after a clerk loaded food into the base and closed the lid. The base and lid each have trapping portions (20, 22) and pull-open portions (24, 32) with a tear-tab, or tear-open barrier (80). To close the lid, a clerk projects a tab (30) on the pull-open portion of the lid through a slot (26) in the pull-open portion of the base, and then presses down the entire trapping portion of the lid into the trapping portion of the base. The lid cannot be lifted up because the tear-open barrier (80) forming the top wall of the slot lies over the tab. To open the container, a person must tear the barrier so he/she can pull up the tab 30 and open the lid. The fact that the barrier has been torn is obvious.

17 Claims, 8 Drawing Sheets

ENHANCED TAMPER EVIDENT BOWL WITH BLOCKED TAB

CROSS-REFERENCE TO RELATED APPLICATION

The present application is a divisional of U.S. application Ser. No. 11/315,654, which was filed on Dec. 21, 2005, and issued as U.S. Pat. No. 8,833,589 B2 on Sep. 16, 2014, and which is incorporated by reference herein in its entirety.

BACKGROUND OF THE INVENTION

Food is often placed in a transparent plastic container that includes a base with a large volume cavity that holds the food and with a cover or lid that closes the cavity. Buyers want to be assured that, after the food was placed in the container as by a clerk at the food store, that the container has not been opened. There is a possibility that another customer has secretly opened the container enough to taste a bit of the food before closing it (and possibly leaving germs from his/her finger in the food). Potential buyers want to be assured that this has not happened. A container constructed by the container manufacturer that allowed a clerk at the store to automatically activate a device that clearly indicated to a potential customer whether or not the container has been opened since it was first closed by the clerk, would be of value.

SUMMARY OF THE INVENTION

In accordance with one embodiment of the invention, a container is provided of the type that includes a base and lid, which allows the lid to be closed and thereafter prevents the lid from being opened unless a barrier is broken. The container and lid each have trapping portions and pull-open portions with a tear-open barrier on the base of the pull-open portion. The tear-tab, or tear-open barrier forms the upper wall of a horizontal slot. The pull-open portion of the lid has a pull-up tab that is projected through the slot when the lid is closed. When the lid is closed the trapping portion of the base traps the lid in the closed position and prevents the lid from opening unless the pull-open side of the lid is pulled up. To open the lid, the barrier must be broken, so the pull-up tab on the lid can be pulled up to release the lid from the base.

The trapping side of the base has a trapping wall that extends at a downward-outward incline (with respect to the container axis) and has a stop wall that extends radially inward from the bottom of the trapping wall. The lid has a peripheral lip that can be pressed down along the trapping wall until the lip reaches the stop wall. The lip then cannot be raised so the lid is trapped in the closed position until the barrier is torn so the pull-up tab can be pulled up.

The base has a seal wall lying below the stop wall, the seal wall having a concave radially inner surface that extends at a downward-inward incline. The lid has a corresponding seal wall with a convex outer surface that lies facewise against the concave surface of the base to form a fluid tight seal.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
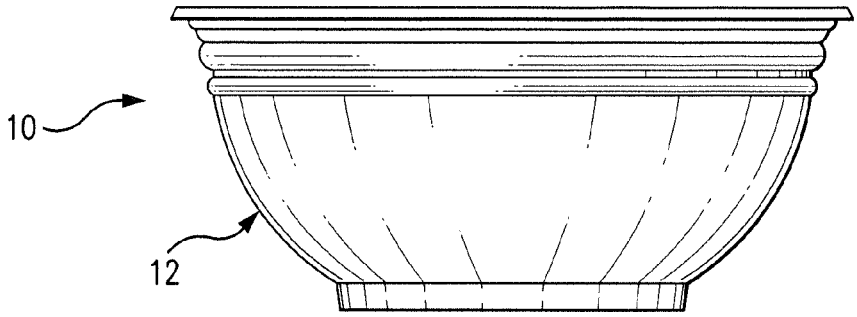
FIG. 1 is a side elevation view of a container of the invention, with the lid closed on the base.
Figure 2:
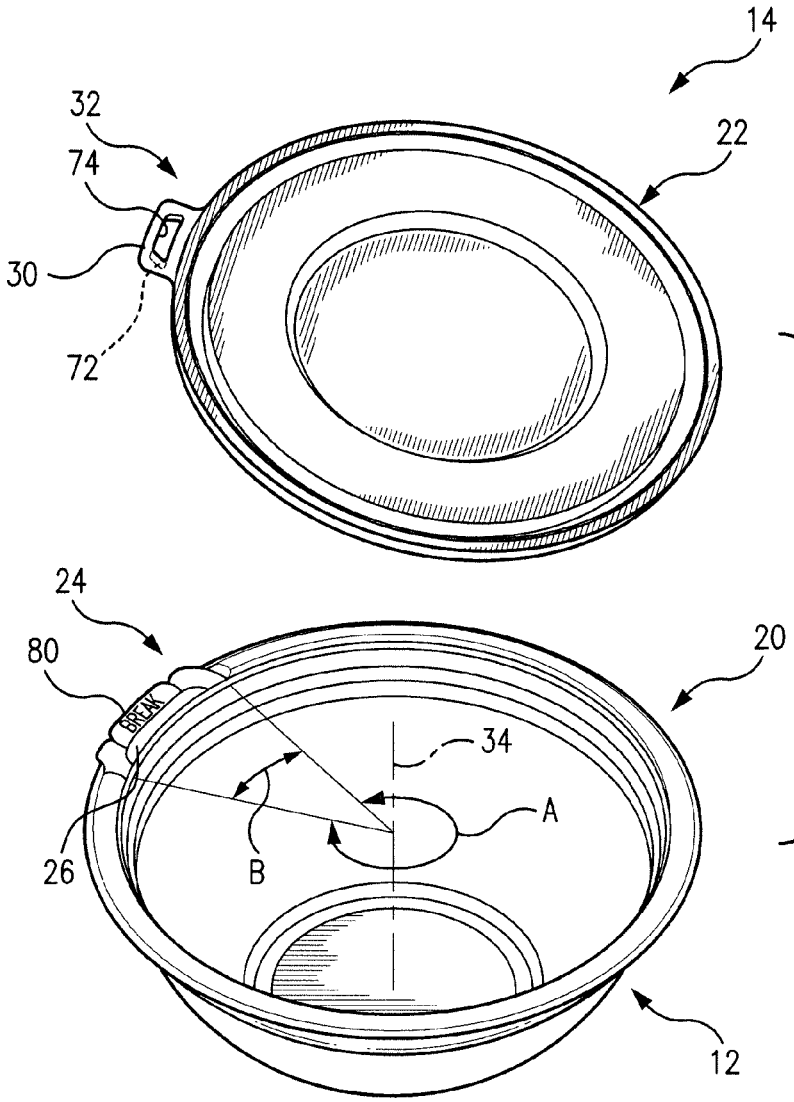
FIG. 2 is an exploded isometric view of the base and lid of the container of FIG. 1.
Figure 3:
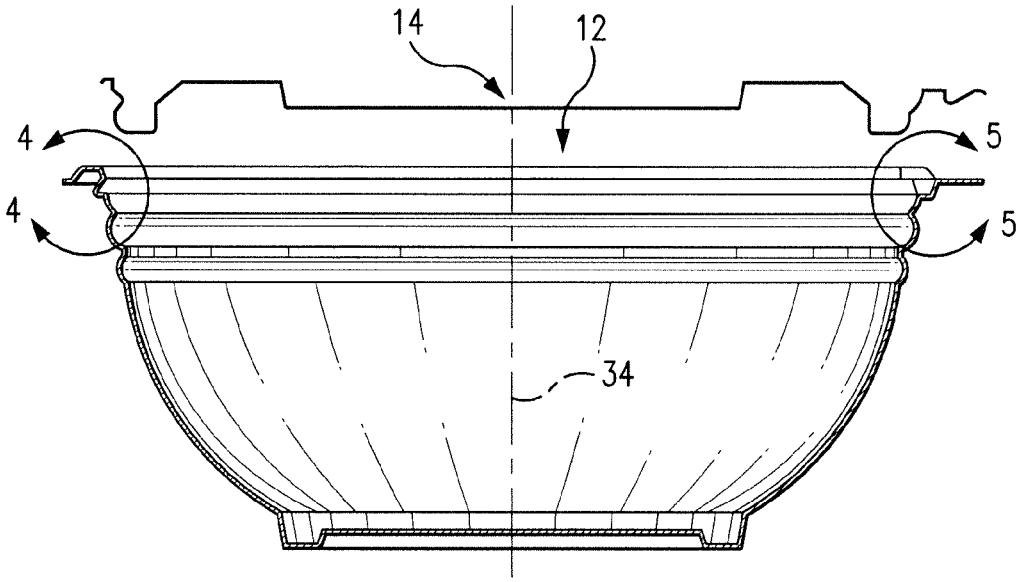
FIG. 3 is an exploded sectional side view of the container of FIG. 1.

FIGS. 1 and 2 show a bowl-shaped container 10 of the invention, which includes a base 12 and a lid 14 that can be closed on the base. The base and lid are constructed of plastic sheeting which has been deformed as by vacuum forming. The particular base and lid of FIG. 1 are formed to two pieces of plastic sheet. The base has a trapping side or portion 20 that receives a trapping portion 22 of the lid and thereafter resists lid removal. The base also has a pull-open side or portion 24 with a horizontally open slot 26 that receives a lift tab, or pull-up tab 30 of a pull-open or pull-out portion 32, or section, of the lid. The trapping portions or sections of the base and lid extend at an angle A of at least 300° around the vertical axis 34 of the closed container. The trapping portion could extend 360°. The pull-open portions of the base and lid extend by an angle B that is preferably less than 90° around the axis.

Figure 6:
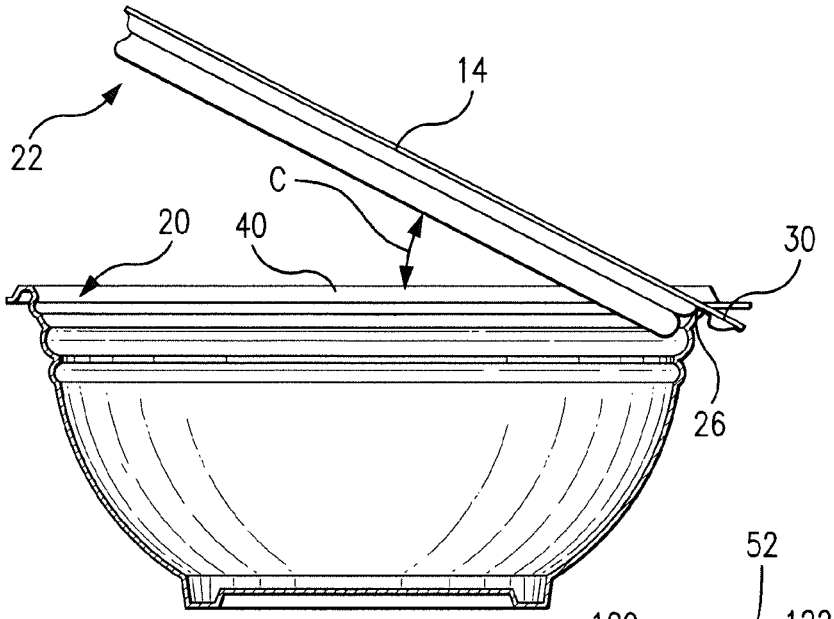
FIG. 6 is a side view of the container of FIG. 3, with the base shown in section and the lid shown in elevation, showing the tab of the lid being projected though a slot in the base, during first closing of the container.
Figure 7:
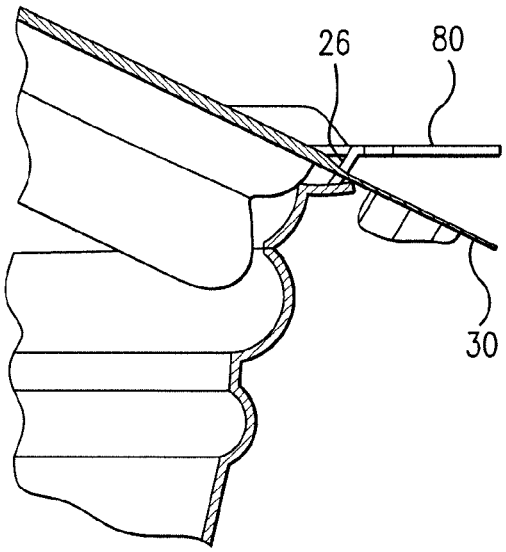
FIG. 7 is an enlarged view of an area of FIG. 6, showing the tab projected though the slot during the first closing of the container.

The lid is installed in the manner shown in FIG. 6, by holding the lid 14 at an incline C such as about 30° to the horizontal and to the top 40 of the base, and projecting the tab 30 of the lid through the slot 26 in the base. Then the trapping portion 22 of the lid is pushed down forcefully into the trapping portion 20 of the base. This results in the trapping portion of the lid being trapped in place deep in the base.

Figure 4:
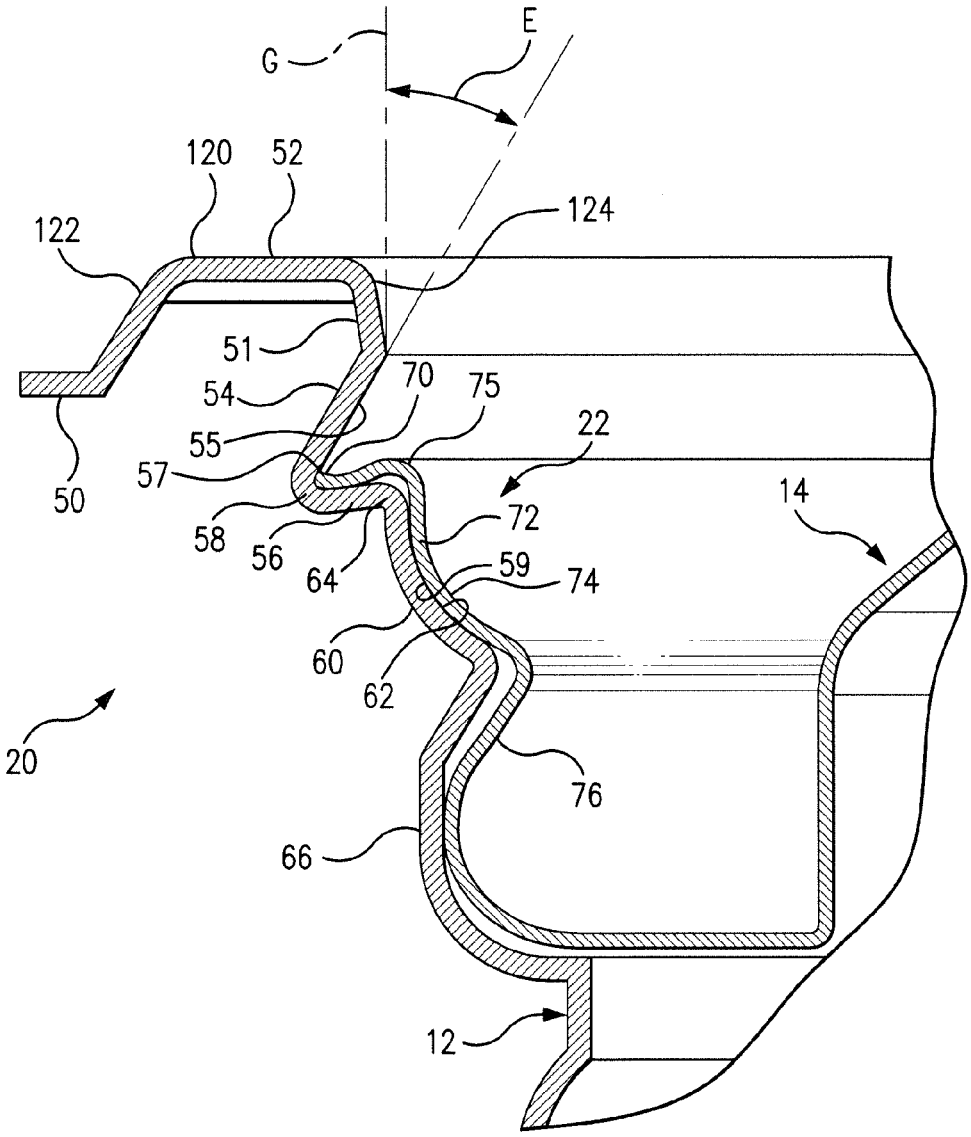
FIG. 4 is an enlarged sectional view of area 4-4 of FIG. 3, with the lid closed on the base.

FIG. 4 shows the trapping portions 20, 22 of the base and. lid in their fully trapped positions. The base has an outer edge part 50, and has an upward flange 52 extending radially inward of and above the base outer edge. The term "radially" describes a direction with respect to the axis 34 of the container, so "radially inward" or just "inward" means toward the axis and "radially outward" or just "outward" means away from the axis. Terms such as "inner" surface means the surface closest to the axis.

The base shown in FIG. 4 has a trapping wall 54 with an inside surface 55 extending at a downward and radially outward incline from the inside of flange 52, and has a stop wall 56 that lies at the bottom of the trapping wall. The trapping wall is joined to the stop wall at a corner 58 that has an inside corner 57, and the stop wall extends radially inward from the corner 58. The base also has an upper seal wall 60 with a concave inner surface 62, that extends at a downward-inward incline from a corner 64 at the inside of the stop wall. The base has a lower seal wall 66. The lid has corresponding walls, including a radially outward free peripheral lip 70, and an upper seal wall 72 with a convex outside surface 59 and with a concave inner surface 74. The surface 74 is joined to the lip by a large radius corner 75 whose radius is larger than that of the base corner 64. The lid also has a lower seal wall 76. The inside radius of curvature of the lid corner 75 is at least 150% of the radius of curvature of the inside of the base corner 64.

When the lid is pushed down forcefully into the base, the peripheral lip 70 of the lid snaps down to the position shown in FIG. 4, with the lip 70 lying at the bottom of the trapping wall 54, at the corner 58. The trapping wall 54 extends at a downward-outward incline from a vertical G, which is preferably between 5° and 30° to the vertical. The peripheral lip 70 is unreinforced so it readily bends up when pushed down along the inside of the trapping wall, and then is trapped in place. The peripheral lip 70 could be forcefully pulled up, but a person cannot firmly grasp the lip to pull it up, and it requires a large upward force to pull it up. It is easy to push down the lip into place but almost impossible to pull up the lip, unless the pull-open portion of the lid is first pulled up.

Figure 5:
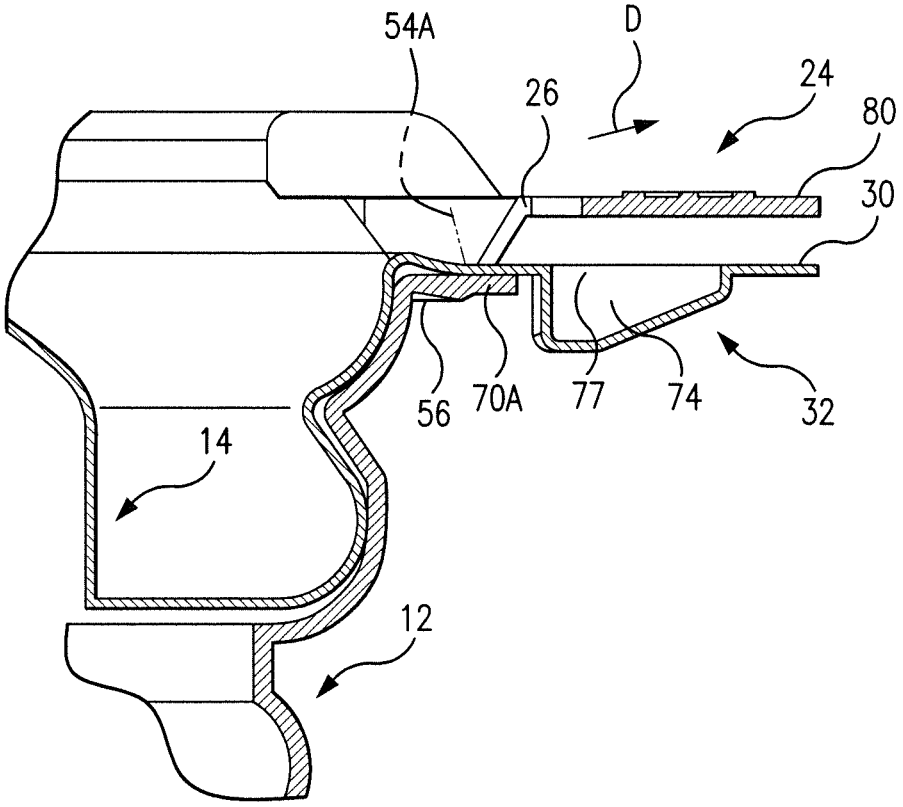
FIG. 5 is an enlarged sectional view of area 5-5 of FIG. 3, with the lid closed on the base.

FIG. 5 shows the pull-open portions 24, 32 of the base and lid when the lid has been fully closed on the base. The point 70A represents a location of the same height and radial position where the peripheral lip of the lid would lie at the bottom of the trapping wall at 54A, in the trapping portion of the container. Instead, the pull-open portion of the lid forms the lift tab 30, which projects primarily radially outward through the slot 26 in the pull-open portion of the base. The position otherwise occupied by a trapping wall 54A on the base is devoid of the trapping wall along the pull-open portion. Instead, the base has a tear-tab, or barrier wall, or barrier 80 that forms the upper wall of the slot 26 in the base. The lid forms the pull-up tab 30 that projects primarily radially though the slot 26. The slot 26 has a small enough height and the tab 30 has a sufficient radial length and has stiffeners 77 formed beside a opening 74 in the tab, that a person normally cannot bend the tab and push it inwardly to lie inward of the slot 26 to raise the tab. Instead, the only practical way for a person to raise the tab is to tear away the barrier 80. The opening 74 is in the form of a blind hole.

Figure 8:
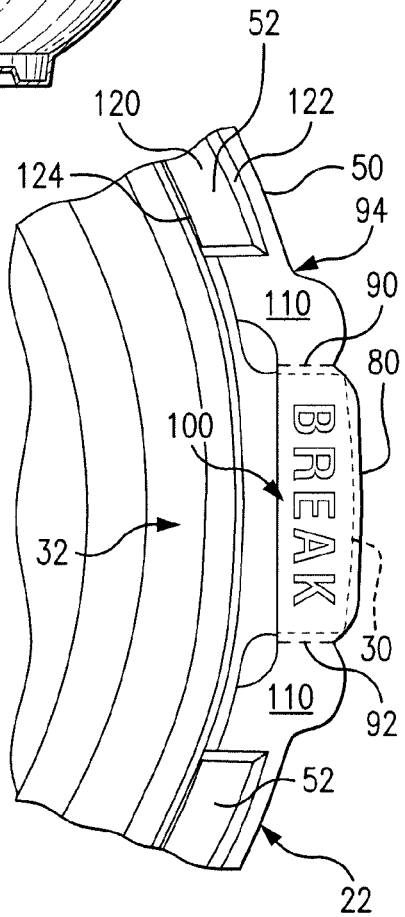
FIG. 8 is a plan view of the area of the container of FIG. 7, after the lid has been fully closed.

FIG. 8 shows that the barrier 80 is attached by two tear joints 90, 92 to a major portion 94 of the base, which is primarily the trapping portion of the base. The tear joints, which extend perpendicular to adjacent parts of the edge 50, are weakened by perforations, notches or by a groove passing partway though the sheet at each tear joint. The barrier has an indication 100, formed by the word "BREAK" that indicates that the barrier should be broken. Upon breaking the barrier 80 at one or both joints, the lift tab 30 can be lifted. When the lift tab is tilted by several degrees (preferably at least 15°) such as 20° or more, the lid can be pulled along the upwardly inclined direction D (FIG. 5) to remove the lid from the base. Once the barrier has been broken, the lid can be repeatedly closed and opened using only moderate force applied to the. lift tab, and the container seals the contents each time the lid is closed.

FIG. 8 shows transition region 110 at opposite sides of the trapping portion 22 of the base. The plastic sheet of the base, which is vacuum formed, has a flat portion between the ends of the flange 52. The flange 52 forms the flange top part 120 and has opposite flange sides 122, 124 that strengthens the upper part of the base to support the weight of other similarly loaded containers that are stacked on one another. A circumferential gap in the flange that is much less than 90°, such as the gap of about 35° occupied by the pull-open portion 32, allows stable stacking of the containers. It can be seen that a first flange side (124) extends at an upward incline from a top of the trapping wall, the flange top part (120), extends at least partially radially outward from a top of the first flange side (124), and a second flange side (122) extends at a downward and radially outward incline from a radially outer end of the flange top part. This results in a loop at the base periphery that resists bending that might allow access to the lid tip 70. An outer edge part (50) of the periphery extends primarily radially outward from a bottom of the second flange side (122), and further resists access to the lid tip 70.

Figures 9, 10:
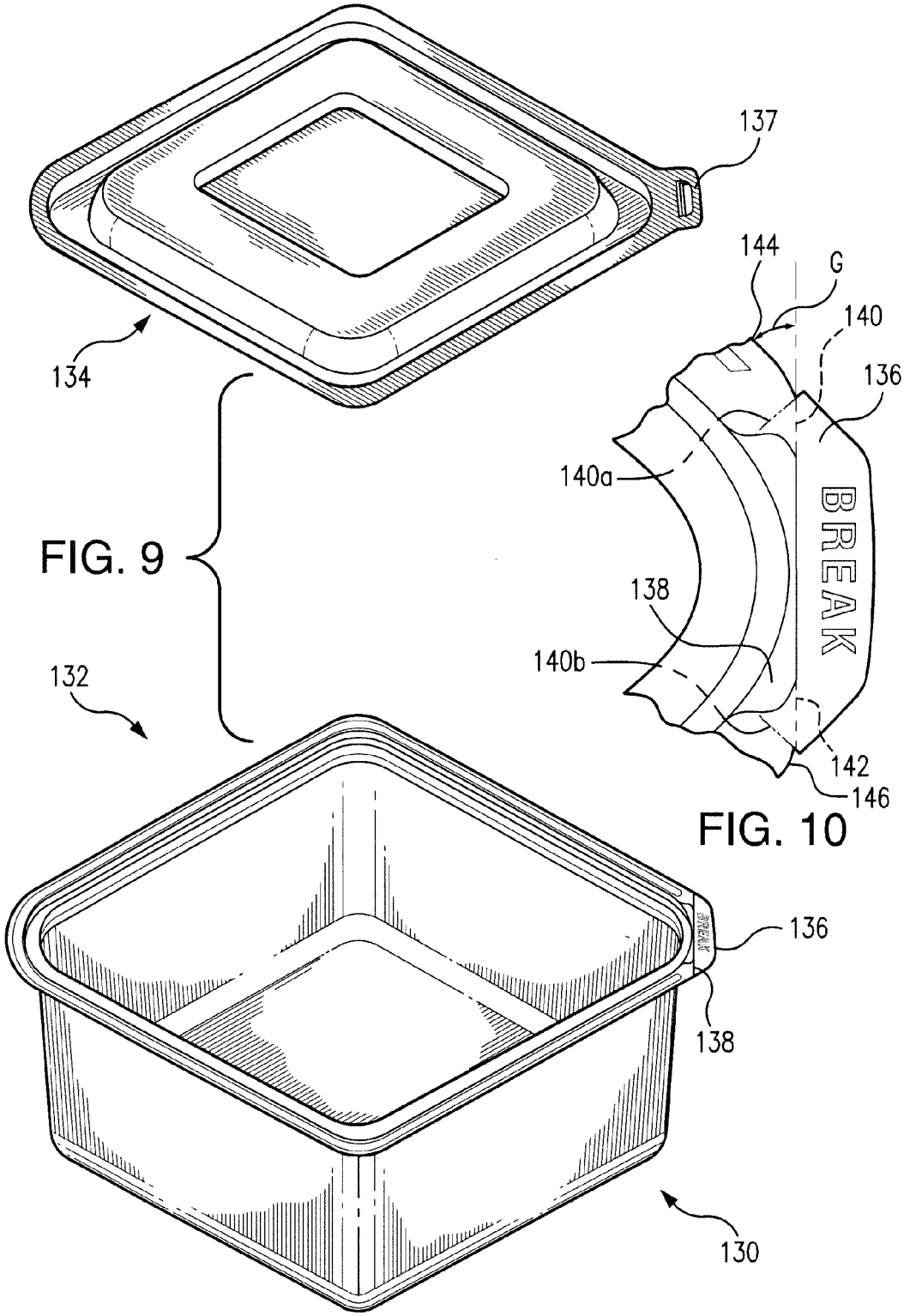
FIG. 9 is an exploded isometric view of another container of the invention, wherein the container is of a polygon shape instead of a bowl shape.
FIG. 10 is a partial plan view of the barrier of the base of the container of FIG. 9.

FIG. 9 shows another container 130 that is similar to the bowl-shaped container of FIGS. 1-8, but that has a regular polygon shape as seen in a plan view. The particular container shown is of square overall parallelepiped shape. The container 130 has a base 132 and lid 134 similar to that of the bowl-shaped container, except that the barrier 136 lies at one corner of the square shape. The lid has a pull-up tab 137 that fits in a slot 138 under the tear-tab barrier 136. FIG. 10 shows that the break lines 140, 142 of the barrier wall extend at angle G of about 45° (which is a plurality of degrees less than 90°) to adjacent sides 144, 146 of the square. If the break lines were positioned at 140*a*, 142*a* where they extended perpendicular to the sides, then this would result in projecting sharp corners, when the barrier 136 was torn off, which might hurt a person.

Figure 11:
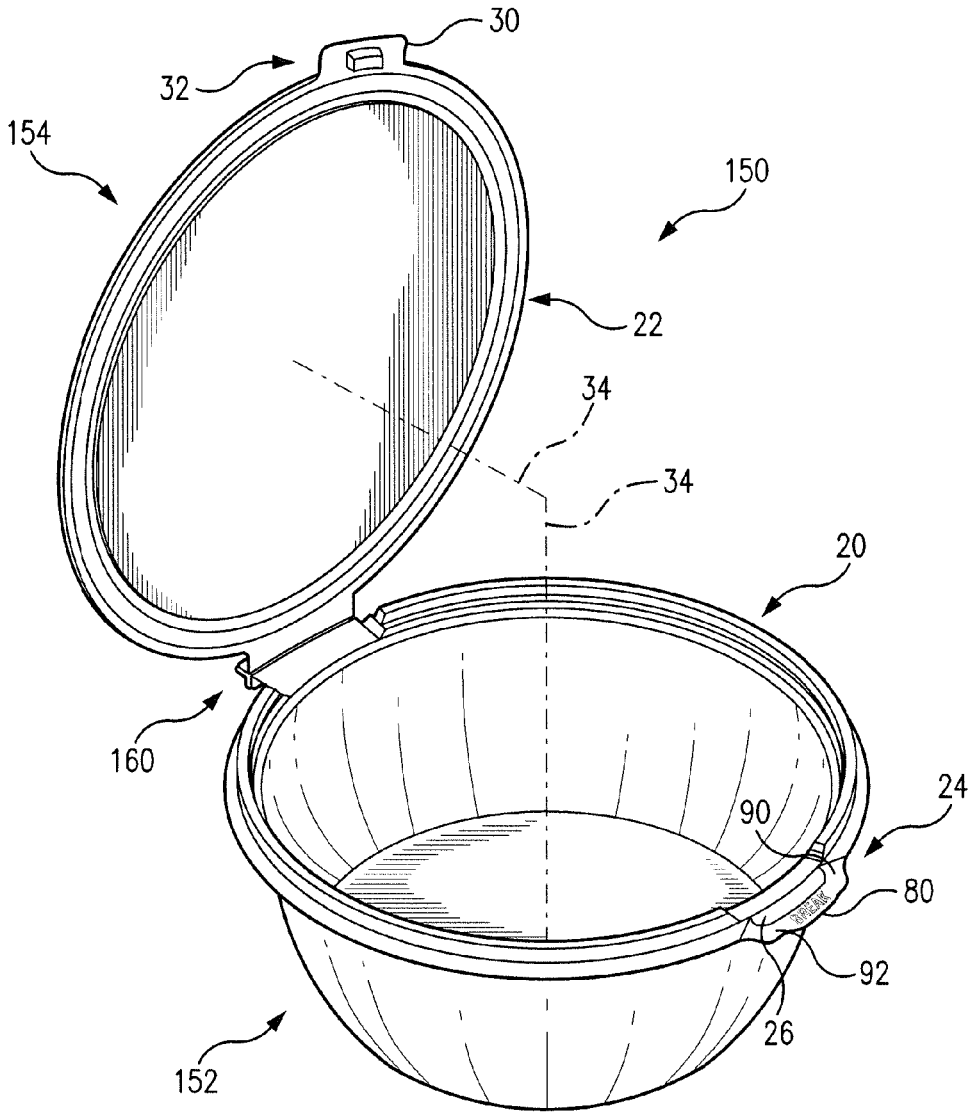
FIG. 11 is a perspective view of another exemplary container, with the lid in an open position.

FIG. 11 illustrates another container 150 that has a shape and construction similar to the bowl of FIGS. 1-8, but wherein the base 152 and lid 154 can be formed of a single piece of sheet plastic. The base and lid are joined by a hinge portion 160. The base and lid have pull open sections 24, 32 and trapping sections 20, 22, 25 of the same construction as the container of FIGS. 1-8.

Figure 12:
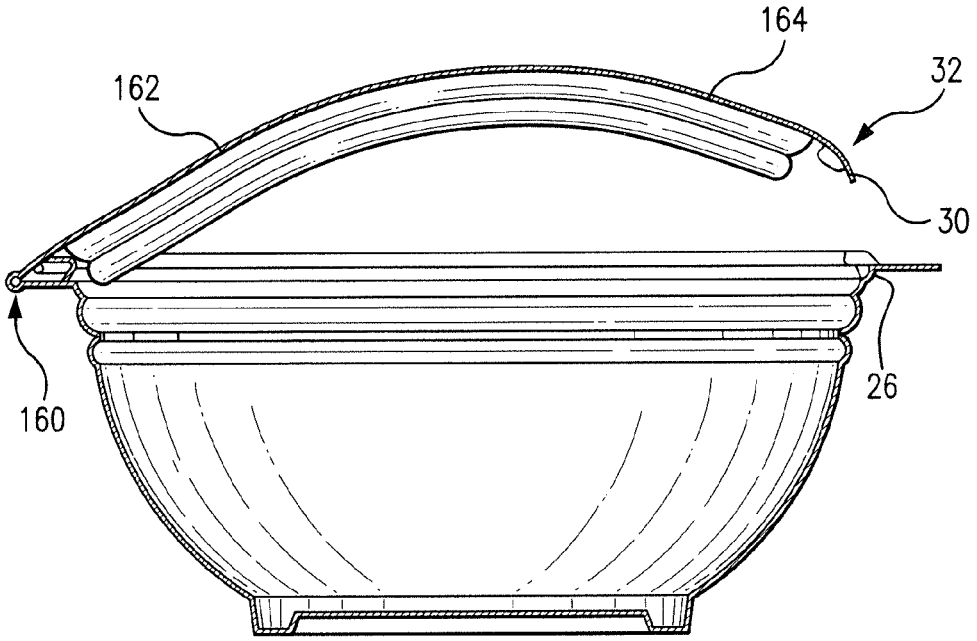
FIG. 12 is a side view of the container of FIG. 11, with the lid extending upward away from the hinge and forming a bend.
Figure 13:
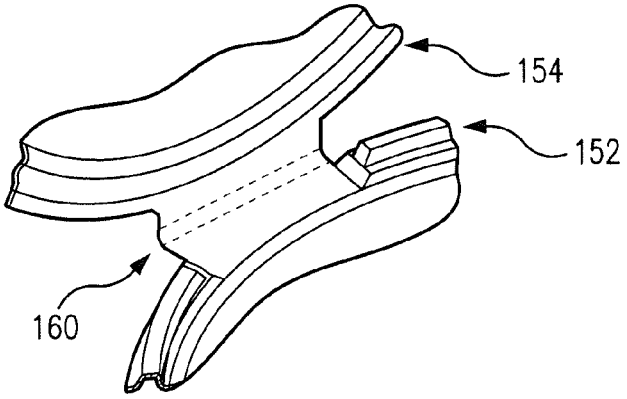
FIG. 13 is an enlarged view of a portion of FIG. 11, illustrating a hinge joining the base to the lid.

FIG. 12 shows the lid with one lid side 162 extending at an upward incline of about 30° away from the hinge 160, and with the lid being bent so its opposite side 164 which is nearest the pullout section 32 extending horizontally or at a downward incline away from the hinge. This shortens the distance from the hinge 160 to the lift tab 30, sufficiently for the lift tab to be inserted through the slot 26. The trapping section 22 (FIG. 11) of the lid is pressed down into the trapping section 20 of the base. Thereafter, the lid can be opened only by tearing one or both tear joints 90, 92, followed by lifting the lift tab 30. FIG. 13 shows one possible construction of the hinge 160 which joins the base 152 to the lid 154.

Thus, the invention provides a container with a base and lid, which enables a store clerk to close the container the first time, after loading food or other goods in the base, and which then prevents the container from being opened without breaking at least one end of a barrier. Of course, the fact that the barrier has been broken is obvious to any customer, so if the customer sees that the tear-open barrier is not broken the customer will be assured that the container has not been opened. The container has trapping and pull-open portions or sections. The trapping section allows the lid to be forced down to a fully installed position and thereafter prevents the lid from being pulled up unless the pull-open section has been lifted and preferably also pulled away slightly from the center of the trapping portion. The container forms a seal around the entire container circumference, which is broken only when the pull-up tab is pulled up.

Although particular embodiments of the invention have been described and illustrated herein, it is recognized that modifications and variations may readily occur to those skilled in the art, and consequently, it is intended that the claims be interpreted to cover such modifications and equivalents.

The invention claimed is:

1. A container formed from sheet plastic, the container comprising:

a base element comprising:

a base trapping section having a trapping wall and a stop wall extending from proximate a bottom of the trapping wall to form an inside corner, the stop wall having a radially inner end, and a base upper seal wall extending downwardly and inwardly from the inner end of the stop wall to define a base corner; and a lid element configured to join to the base element in an installed position, the lid element comprising:

a lid trapping section configured to be received within and secured by the trapping wall in the installed position, the lid trapping section comprising a peripheral lip disposed proximate the inside corner in the installed position, and a lid upper seal wall engaging the base upper seal wall in the installed position, the lid upper seal wall extending from the peripheral lip to define a lid corner, the lid corner having a lid radius of curvature larger than a base radius of curvature of the base corner to form a gap between the lid corner and the base corner.

2. The container described in claim 1, wherein:

the base upper seal wall has a concave inner surface; and the lid upper seal wall has a convex outer surface disposed proximate the concave inner surface of the base upper seal wall in the installed position.

3. The container described in claim 1, wherein:

the base trapping section and lid trapping section each extends at least 300° about the base element and the lid element, respectively.

4. The container described in claim 1, wherein:

the base and lid trapping sections each extends less than 360° about the lid element and the base element, respectively, and each includes a pull-open section extending no more than 90° about the lid element and the base element, respectively;

the lid element includes a tab disposed proximate the pull-open section; and the base element forms a barrier disposed proximate the pull-open section and attached by a tearable joint to the base trapping section to restrict or prevent access to the tab until the joint is torn and the barrier separated from the tab to allow lifting of the tab.

5. The container described in claim 1, wherein the base element further comprises a flange extending radially outwardly from the trapping wall.

6. The container described in claim 1, the base element further comprising a base pull-open section and the lid element further comprising a lid pull-open section, wherein:

the base pull-open section includes a barrier wall defining a slot, at least a portion of the barrier wall is joined to the trapping section by a breakable joint, and the lid pull-open section includes a tab projecting at least partially through the slot when the lid element is in the installed position to resist or prevent lifting of the tab until the breakable joint is broken and the barrier wall is separated from the tab.

7. A container formed from sheet plastic, the container comprising:

a base element comprising:

a base trapping section comprising:

a trapping wall defining at least a portion of a base periphery of the base element, a stop wall extending downwardly and radially outwardly from proximate a bottom of the trapping wall to form an inside corner, a first flange side wall extending upwardly from the trapping wall and defining a portion of the base periphery, a flange top wall extending radially outwardly from the first flange side wall, and a second flange side wall extending downwardly and outwardly from an outer end of the flange top wall; and a lid element configured to join to the base element in an installed position, the lid element comprising a lid trapping section having a resilient peripheral lip engaging the inside corner when the lid element is in the installed position, the second flange side wall configured to resist or prevent access to the peripheral lip when the lid element is in the installed position.

8. The container described in claim 7, wherein the inside corner and the peripheral lip extend 360° about the base element and the lid element, respectively.

9. The container described in claim 7, wherein the base periphery is at least partially defined by an outer edge extending outwardly from the second flange side wall.

10. The container described in claim 7, the base element further comprising a base pull-open section and the lid element further comprising a lid pull-open section;

the base pull-open section comprising a barrier wall defining a slot, at least a portion of the barrier wall joined to the base trapping section by a breakable joint; and the lid pull-open section comprising a tab projecting at least partially through the slot when the lid element is in the installed position to resist or prevent lifting of the tab until the breakable joint is broken and at least a portion of the barrier wall is separated from the tab.

11. A container formed from sheet plastic, the container comprising:

a base element comprising a base trapping section extending at least 180° about the base element, the base trapping section including a trapping wall and a stop wall extending inwardly from proximate a bottom of the trapping wall to form an inside corner, and a lid element configured to join to the base element in an installed position, the lid element comprising a lid trapping section extending at least 180° about the lid element and configured to be received within and secured by the trapping wall when the lid element is in the installed position, the lid trapping section including a peripheral lip configured to engage the trapping wall proximate the inside corner when the lid element is in the installed position wherein the base element and lid element each defines a portion of a pull-open section, the lid element comprises a tab formed proximate the pull-open section, the base element is configured to resist or prevent lifting of the tab until at least a portion of a barrier is separated from the base element, the barrier having an indication formed thereon to provide an instruction to separate the barrier from the base element.

12. The container described in claim 11, wherein:

the base element has a top wall defining an outer lip along the base trapping section, the base element has a flange portion disposed radially inward from the outer lip and having a flange top wall, and opposing inner and outer flange walls extending from the flange top wall, the inner flange wall extending from a top of the trapping wall to the flange to wall; and wherein the base element is free of the flange portion proximate an intersection of the base trapping section and the pull-open section.

13. The container described in claim 12, wherein the lid element is joined to the base element by a hinge disposed opposite the pull-open section.

14. A container formed from sheet plastic, the container comprising:

a base element comprising:

a base trapping section comprising:

a trapping wall, a stop wall extending from a bottom of the trapping wall to form an inside corner, a first flange side wall extending upwardly from the trapping wall, a base periphery of the base element defined at least in part by the trapping wall and the first flange side, a flange top wall extending outwardly from the first flange side, and a second flange side wall extending downwardly from an outer end of the flange top wall; and a lid element configured to be received by the trapping wall in an installed position to resist or prevent lifting of the lid element, the lid element comprising a lid trapping section including a resilient peripheral lip configured to engage the inside corner when the lid element is in the installed position, the second flange side wall configured to restrict or prevent access to the peripheral lip when the lid element is in the installed position.

15. The container described in claim 14, wherein the inside corner and the peripheral lip extend 360° about the base element and the lid element, respectively.

16. The container described in claim 14, wherein the base periphery is defined at least in part by an outer edge extending outwardly from the second flange side wall.

17. The container described in claim 14, the base element further comprising a base pull-open section and the lid element further comprising a lid pull-open section;

the base pull-open section including a barrier wall defining a slot, at least a portion of the barrier wall joined to the trapping section by a joint; and the lid pull-open section including a tab projecting at least partially through the slot when the lid element is in the installed position to resist or prevent lifting of the tab until the joint is broken and the barrier wall is separated from the tab.

* * * * *